United States Patent [19]

Orr

[11] 4,027,460

[45] June 7, 1977

[54] COMMODITY PACKAGING SYSTEM

[75] Inventor: Brian Orr, Hoghton, near Preston, England

[73] Assignee: F. B. Mercer, Limited, England

[22] Filed: Jan. 20, 1976

[21] Appl. No.: 650,777

[30] Foreign Application Priority Data

Jan. 21, 1975 United Kingdom ..... 2616/75

[52] U.S. Cl. ..... 53/162; 53/180 M; 53/183

[51] Int. Cl.² ..... B65B 5/02; B65B 9/10; B65B 35/50

[58] Field of Search ..... 53/28, 29, 162, 163, 53/183, 182 M, 180 M, 18 T, 193, 245, 249, 390; 141/275–278

[56] References Cited

UNITED STATES PATENTS

| | | | |
|---|---|---|---|
| 2,910,193 | 10/1959 | Lindeman et al. | 53/162 X |
| 3,924,522 | 12/1975 | Martin | 53/28 X |
| 3,940,906 | 3/1976 | Leckband et al. | 53/183 X |

*Primary Examiner*—Robert Louis Spruill
*Attorney, Agent, or Firm*—Stevens, Davis, Miller & Mosher

[57] ABSTRACT

Apparatus for packaging commodities particularly delicate articles consists of a hollow vertical mandrel over which a tubular flexible packaging material is driven. The material is axially slit as it passes over the mandrel to allow the commodities to be inserted into the mandrel through a product opening and the tube is axially resealed and transversely sealed on issuance from the mandrel discharge end. According to the invention a platform is provided below the mandrel which is lifted into the mandrel interior so that the commodities can be inserted through the product opening and supported by the platform to prevent their dropping through the mandrel interior. The platform is then retracted to provide descending continuous support for the commodities during the remainder of the packaging process.

2 Claims, 10 Drawing Figures

COMMODITY PACKAGING SYSTEM

Figure 1:
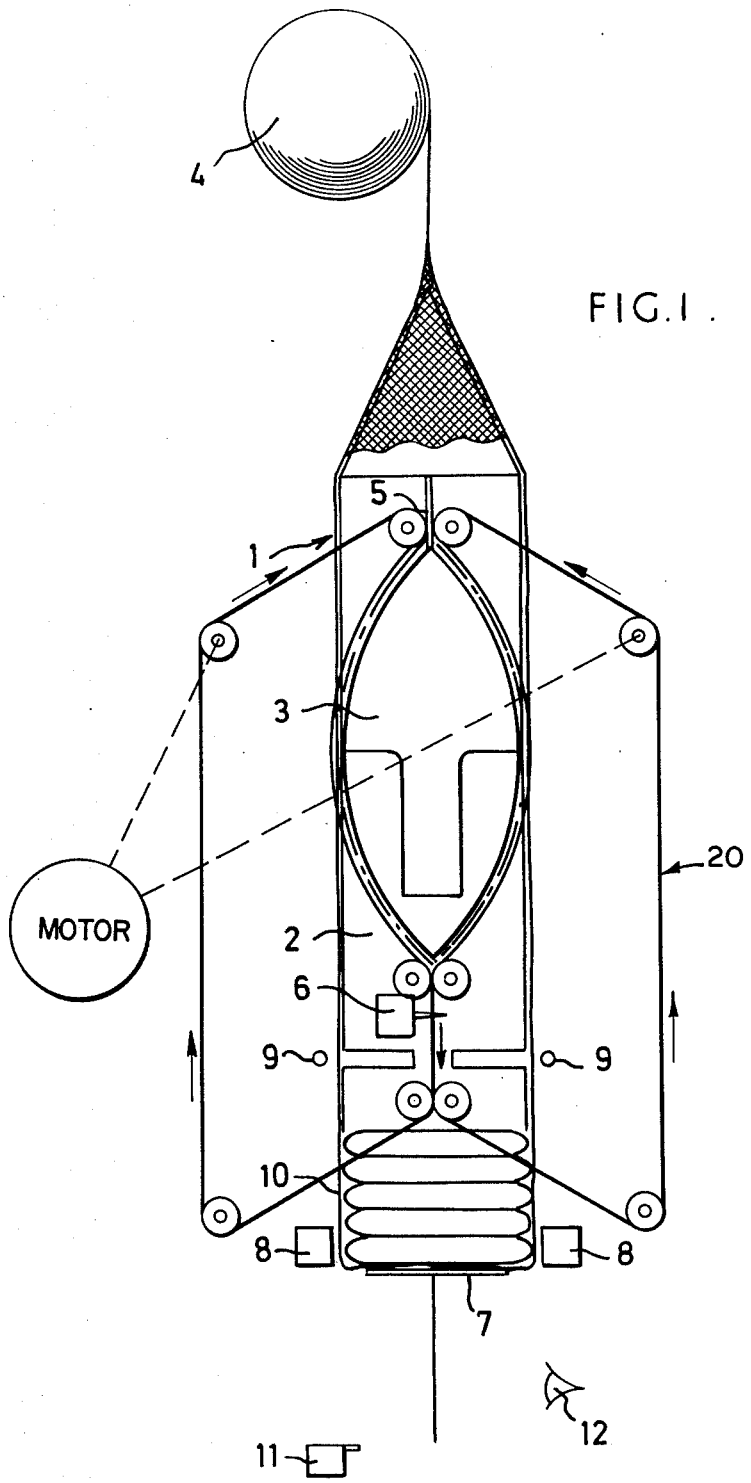

This invention relates to a packaging system for the making and filling of tubular packages for the packing of commodities particularly articles which are delicate to handle or which need to be neatly stacked, for example sachets of frozen foods such as beans, peas, potato chips or the like or tobacco tins, cheese cartons, ice cream tubs, mousse tubs etc. The invention is a modification of the invention disclosed in U.S. Pat. No. 3,924,522.

In U.S. Pat. No. 3,924,522 there is disclosed a method and apparatus for forming commodity packages in which a tubular flexible packaging material is passed axially along an elongate mandrel including a hollow feed portion with the packaging material enclosing the mandrel, the packaging material is continuously axially slit as it passes over the mandrel and the severed edges of the packaging material defining the slit are taken in charge by guide means moving along the mandrel to guide the severed edges around the product opening in the surface of the hollow portion of the mandrel and into sealing juxtaposition downstream of said opening to allow the packaging material to be sealed so that the material reverts to a continuous tube with an axial seal.

The present invention provides apparatus for forming commodity packages comprising an elongate vertically extending mandrel having a hollow feed portion with a product opening leading to the mandrel interior and a lower discharge end, drive means for passing a tubular flexible packaging material axially and downwardly along the mandrel while allowing commodities to be inserted into the mandrel interior through the product opening, transverse sealing means below the discharge end of the mandrel for forming transverse seals in the packaging tube and a platform provided below the mandrel for lifting movement into an upper position in which the platform is situated within the hollow portion of the mandrel to lift a previously transversely sealed end portion of the packaging tube depending from the discharge end of the mandrel into the hollow portion of the mandrel and to allow a commodity or a stack of commodities inserted into the hollow portion through the product opening to be supported by the platform on an internal surface of said previously sealed end portion of the packaging tube, the platform then being adapted downwardly to withdraw from the mandrel to release the previously sealed end portion of the packaging tube with the included commodity or commodities from within the mandrel for subsequent transverse sealing of the tube above the commodity or commodities to form a package.

The invention is particularly useful when applied to a system as disclosed in U.S. Pat. No. 3,924,522 in which the tubular packaging material is axially slit as it passes over the mandrel the severed edges are guided around the product opening and then resealed with an axial seal. However the invention is also applicable to other packaging systems employing hollow feed-tube type mandrels, for example systems in which a sleeve of tubular packaging material is gathered on the mandrel and gradually payed off to form packages which receive commodities from the mandrel interior, or systems in which the tubular material is formed by helically winding flat web material around the mandrel and sealing the helical lays together while the material progresses along the mandrel, the tubular material again in this case receiving a commodity from the mandrel interior.

The invention will now be described by way of example with reference to the accompanying drawings in which:

FIG. 1 is a semi-diagrammatic side view of a commodity packaging apparatus in accordance with the invention and FIGS. 2 to 10 are diagrams illustrating the various stages of operation of the apparatus in a packaging cycle.

A vertically disposed mandrel 1 has a hollow feed portion 2 with a cut-out 3 in the wall thereof forming a product inlet opening and combined guide belt and drive system 20 is provided for drawing tubular packaging material, conveniently extruded plastics netting, from a reel 4 over and along the mandrel with the tubular material enclosing the mandrel. The tubular material is continuously axially slit as it passes over the mandrel by a suitable knife blade positioned at location 5 and the slit edges of the material are taken in charge guided around the product opening and brought into sealing juxtaposition downstream of the opening by the drive and guide belt system for sealing together of the several edges by a sewing machine 6 so that the packaging material reverts to a continuous tube with an axial sewn seam. The apparatus thus far described is precisely as disclosed in U.S. Pat. No. 3,924,522

Below the lower discharge end of the mandrel is provided a vertically movable and tiltable platform 7 operated for example by a pneumatic or rack and pinion ram or the like and the apparatus further includes a gathering, clipping and cutting device 8 and tensioning rods 9 operative in slots formed in the lower end of the mandrel.

The operation of the apparatus will be described with reference to FIGS. 2 to 10.

Figures 2, 3, 4:
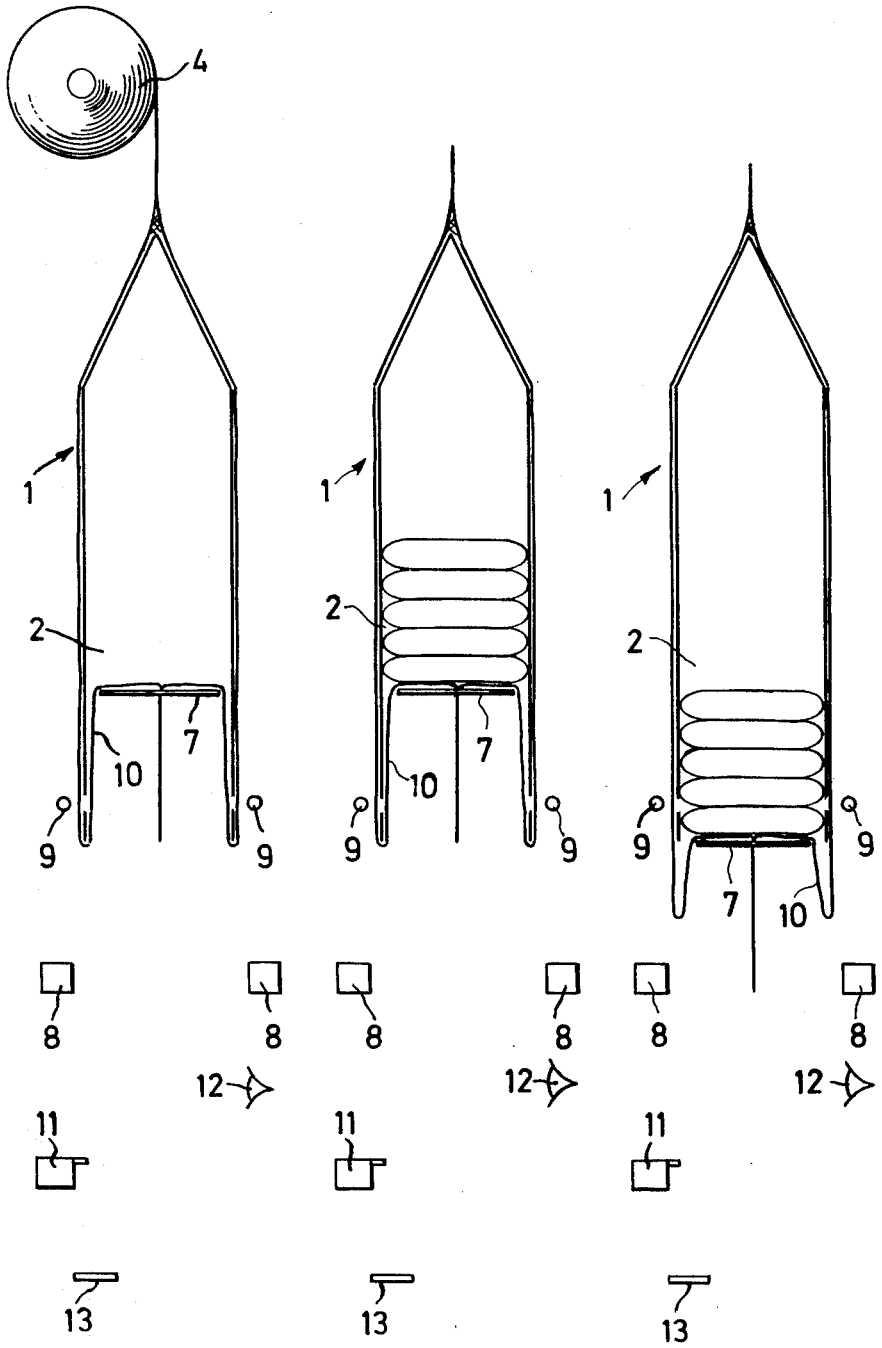
Figures 5, 6, 7:
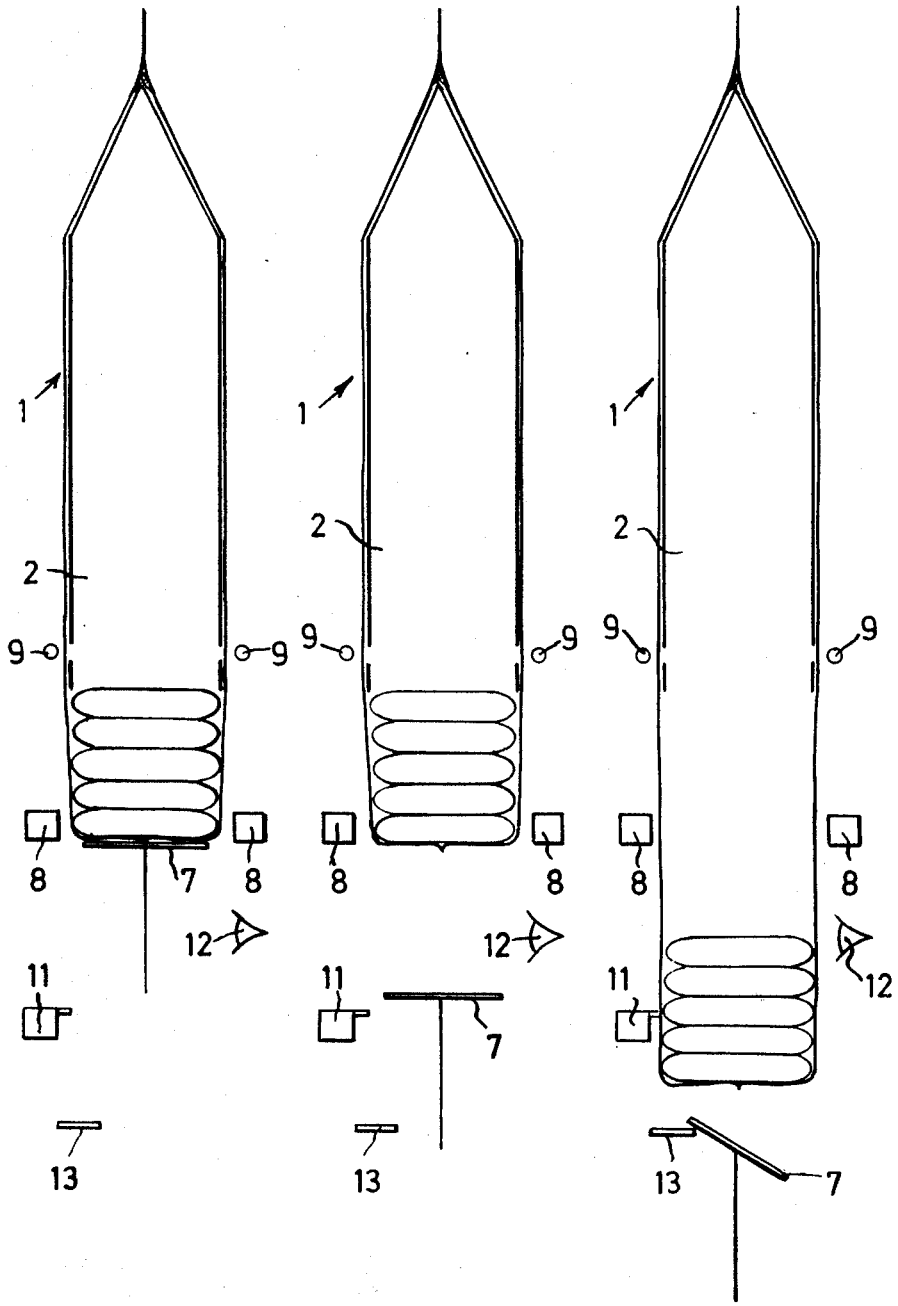
Figure 8:
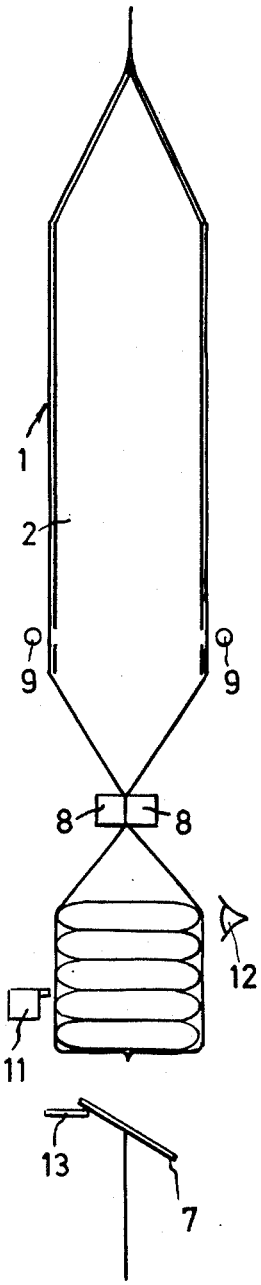
Figure 9:
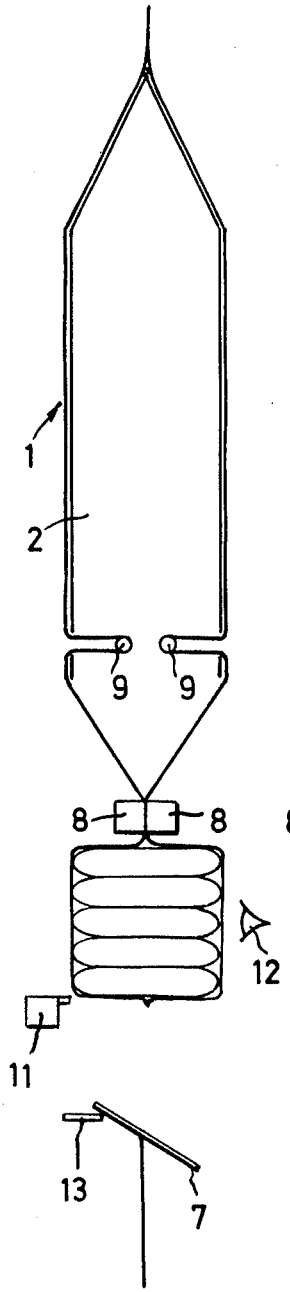
Figure 10:
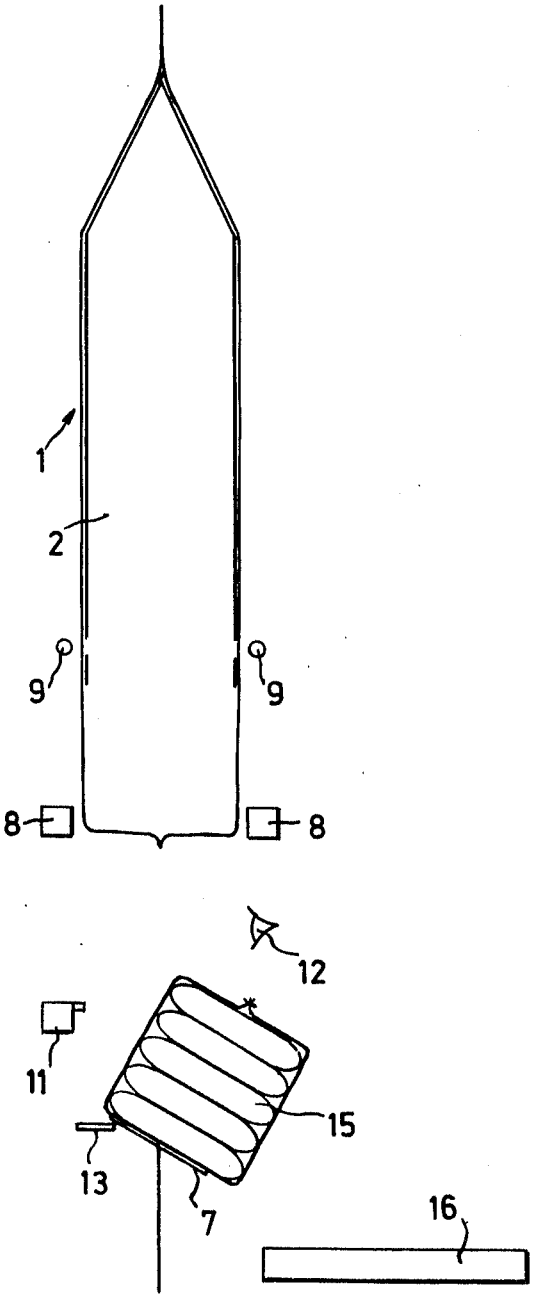

It is assumed that initially the lowermost end of the packaging tube extends a distance below the discharge end of the mandrel and that this end has been sealed in a previous operation (FIG. 10). Then, the platform 7 is raised from its lowermost (FIG. 10) position to its uppermost position (FIG. 2) to lift the end portion 10 of the packaging tube into the interior of the hollow mandrel portion. The operator loads commodities into the mandrel interior through the product opening 3 so that the commodities are supported in the interior of the end portion 10 of the packaging tube by the platform 7 (FIG. 3). The operator then depresses a switch (not shown) for lowering the platform which descends while supporting the commodities (FIGS. 4 and 5). The lowering platform continues its descent leaving the commodities hanging in the end portion of the tube (FIG. 6) until the platform operates a switch 11 which causes the guide and drive belt system of the apparatus (until now stationary) to operate so that the packaged commodities are lowered in the packaging tube until a photo-electric cell 12 senses the passage of the top of the commodity pile (FIG. 7) causing the drive and guide belt system to stop. The platform meanwhile has continued its descent until it is tilted (against a spring action) by a bracket 13.

The photo-electric cell 12 apart from signalling the guide belt system to stop, also signals the gathering clipping and cutting device 8 to operate to gather the net tube into a jaw of the device (FIG. 8) and a signal is then passed to the rods 9 to move inwardly in the mandrel slots to lift the commodity-filled end of the tube through the jaw (FIG. 9) to tension the package. When this movement has been completed the clipping and cutting mechanism operates to form a pair of spaced seals in the packaging tube and sever the tube between the seals. The completed package 15 then drops onto the tilted platform 7 (FIG. 10) and is deflected on to a receiving conveyor 16 and the platform returns to its uppermost (FIG. 2) position to commence the next packaging cycle.

I claim:

1. In an apparatus for forming commodity packages comprising an elongate vertically extending mandrel having a hollow feed portion with a product opening leading to the mandrel interior and a lower discharge end, drive means for passing a tubular flexible packaging material axially and downwardly along the mandrel while allowing commodities to be inserted into the mandrel interior through the product opening and transverse sealing means below the discharge end of the mandrel for forming transverse seals in the packaging tube, the improvement comprising a platform provided below the mandrel for lifting movement into an upper position in which the platform is situated within the hollow portion of the mandrel to lift a previously transversely sealed end portion of the packaging tube depending from the discharge end of the mandrel into the hollow portion of the mandrel and to allow a commodity or a stack of commodities inserted into the hollow portion through the product opening to be supported by the platform on an internal surface of said previously sealed end portion of the packaging tube and for lowering movement to withdraw from the mandrel to release the previously sealed end portion of the packaging tube with the included commodity or commodities from within the mandrel for subsequent transverse sealing of the tube above the commodity or commodities to form a package and means to move said platform upwardly into said mandrel and downwardly to withdraw from said mandrel.

2. Apparatus as claimed in claim 1 including slitting means associated with the mandrel for continuously axially slitting the packaging material as it passes over the mandrel, said drive means including guide means movable along the mandrel for taking the severed edges of the material defining the slit in charge to guide the severed edges of the material around the product opening in the surface of the hollow portion of the mandrel and into sealing juxtaposition downstream of said opening and axial sealing means associated with the mandrel downstream of said opening for sealing the juxtaposed severed edges of the material so that the material reverts to a continuous tube with an axial seal.

* * * * *